US010317092B2

(12) United States Patent
Desor et al.

(10) Patent No.: US 10,317,092 B2
(45) Date of Patent: Jun. 11, 2019

(54) HORIZONTAL HINGE FOR A HOUSEHOLD APPLIANCE DOOR

(71) Applicant: BSH Hausgeräte GmbH, Munich (DE)

(72) Inventors: Jürgen Desor, Strasbourg (FR); Jérémy Buchmann, Plobsheim (FR)

(73) Assignee: BSH Hausgeräte GmbH, Munich (DE)

( * ) Notice: Subject to any disclaimer, the term of this patent is extended or adjusted under 35 U.S.C. 154(b) by 4 days.

(21) Appl. No.: 15/630,981

(22) Filed: Jun. 23, 2017

(65) Prior Publication Data

US 2018/0017266 A1 Jan. 18, 2018

(30) Foreign Application Priority Data

Jul. 15, 2016 (EP) ..... 16290135

(51) Int. Cl.

*F23M 7/00* (2006.01)
*F24C 15/02* (2006.01)
*E05F 1/12* (2006.01)

(52) U.S. Cl.

CPC ..... *F24C 15/023* (2013.01); *E05F 1/1261* (2013.01); *E05Y 2800/422* (2013.01); *E05Y 2900/308* (2013.01)

(58) Field of Classification Search

CPC ..... F24C 15/023; E05F 1/1261; E05F 3/20
USPC ..... 126/190–200; 16/289, 281, 290, 286
See application file for complete search history.

(56) References Cited

U.S. PATENT DOCUMENTS 3,187,374 A * 6/1965 Lundell ..... A45C 13/34 16/289
3,950,819 A * 4/1976 Little ..... E05F 1/1058 16/290
2007/0209654 A1* 9/2007 Wang ..... E05F 1/1276 126/194
2011/0247176 A1* 10/2011 Vanini ..... E05F 1/1058 16/297

FOREIGN PATENT DOCUMENTS

DE 102005017085 A1 10/2006
WO 2013133774 A1 9/2013

OTHER PUBLICATIONS

National Search Report EP 17 17 9907 dated Dec. 5, 2017.

* cited by examiner

*Primary Examiner* — Vivek K Shirsat
(74) *Attorney, Agent, or Firm* — Michael E. Tschupp; Andre Pallapies; Brandon G. Braun

(57) ABSTRACT

A horizontal hinge for a cooking appliance door includes a hinge housing having a front face and a rear face. A rotatable hinge arm protrudes from the front face of the hinge housing for retaining the cooking appliance door. Protruding from the rear face of the hinge housing is a lifting rod which is coupled to the hinge arm and pivotable when the hinge arm is caused to rotate. Placed over the lifting rod outside the hinge housing is a compression spring which is held under compressive stress between the hinge housing and a bearing portion of the lifting rod. A tilting element tiltably bears against the hinge housing between the compression spring and the hinge housing.

20 Claims, 6 Drawing Sheets

HORIZONTAL HINGE FOR A HOUSEHOLD APPLIANCE DOOR

CROSS-REFERENCES TO RELATED APPLICATIONS

This application claims the priority of European Patent Application, Serial No. EP 16290135, filed Jul. 15, 2016, pursuant to 35 U.S.C. 119(a)-(d), the disclosure of which is incorporated herein by reference in its entirety as if fully set forth herein.

BACKGROUND OF THE INVENTION

The invention relates to a horizontal hinge for a domestic appliance door, in particular a cooking appliance door. The invention further relates to a domestic cooking appliance and to a method for mounting a horizontal hinge. The invention is, in particular, advantageously able to be used on horizontal hinges for oven doors, in particular on heavy-duty horizontal hinges.

BRIEF SUMMARY OF THE INVENTION

It would be desirable and advantageous to provide an improved horizontal hinge for domestic appliance doors to obviate prior art shortcomings.

According to one aspect of the present invention, a horizontal hinge for a cooking appliance door includes a hinge housing having a front face and a rear face, a rotatable hinge arm protruding from the front face of the hinge housing for retaining the cooking appliance door, a lifting rod protruding from the rear face of the hinge housing and coupled to the hinge arm, the lifting rod being pivotable when the hinge arm is caused to rotate, a compression spring placed over the lifting rod outside the hinge housing and held under compressive stress between the hinge housing and a bearing portion of the lifting rod, and an element (hereinafter denoted in general as "tilting element") tiltably bearing against the hinge housing between the compression spring and the hinge housing.

This horizontal hinge has the advantage that the tilting element, against which the compression spring presses, is fully adapted to the angular alterations of the lifting rod when rotating the cooking appliance door and thus the hinge arm, by its own pivoting or rotation relative to the hinge housing. The tilting element is thus entrained with the rotation of the lifting rod. Thus the first end of the compression spring facing the tilting element is no longer bent against the length of the compression spring. As a result, in all positions of the lifting rod the compression spring remains entirely straight and undesirable friction is not produced on the lifting rod and thus force losses are also no longer produced. Noise which could occur by the sliding of the compression spring on the lifting rod is additionally avoided.

The compression spring may be a spiral spring. It may bear with a first end on the coupling element and with its second end on the bearing portion of the lifting rod. The first end and/or the second end may be surface ground in order to achieve a rectilinearity of the compression spring in a particularly reliable manner. The compression spring may be supported directly or indirectly, for example via an intermediate element. The lifting rod may run through the spiral spring and/or the spiral spring may be positioned on the lifting rod.

The hinge arm may be inserted into the cooking appliance door. The hinge arm is, in particular, rotatable about a horizontal rotational axis.

It may be understood by the lifting rod being coupled to the hinge arm that it is directly articulated to the hinge arm or that it is indirectly coupled to the hinge arm via a force transmission mechanism (for example an intermediate part guided in the hinge housing). If the cooking appliance door is rotated with the hinge arm, the lifting rod may also rotate (in a vertical plane, not about its own axis). In this case, with an opening procedure or a closing procedure any angular alteration of the hinge arm does not need to effect an angular alteration of the lifting rod, however angular ranges of the opening angle of the hinge arm may also be present in which the angle of the lifting rod is practically unaltered.

The bearing portion of the lifting rod corresponds to a stop or a support for the second end of the compression spring remote from the hinge housing.

It may be understood by the compression spring being held under compressive stress that, in the position of the hinge arm in which the compression spring is relaxed to a maximum extent (for example in a closed position of the hinge arm), the compression spring is fully relaxed.

The tilting element may bear directly (i.e. in direct contact) or indirectly (i.e. via at least one intermediate element) against the hinge housing.

It may be understood by the tilting element being tiltably supported that it is pivotable or tiltable relative to an outer surface of the hinge housing and namely in particular steplessly. The tilting angle which is able to be adopted may, in particular, correspond to the angles of the lifting rod. An advantageous development for reliably keeping the compression spring straight is that the tilting element is not attached at the side.

According to another advantageous feature of the present invention, the tilting element can be or can include a disk ("washer") which in the center has a continuous projecting web, which web faces the hinge housing. Such a washer is robust and compact. It is additionally able to be produced in a particularly simple manner, for example by reshaping a conventional washer, for example by deep-drawing. Such a washer may also be denoted as a "rocker disk". The aforementioned web faces the hinge housing whilst the compression spring is able to bear against the other side of the washer. The web thus provides the (linear) bearing surface relative to the hinge housing, the washer being pivotable about the bearing surface.

In principle, on the side of the tilting element, in particular of a washer, facing the hinge housing, differently shaped projections may also be present as a bearing surface or contact elements relative to the hinge housing. Thus, for example, instead of a web, two or more punctiform projections arranged in series may be present, etc.

According to another advantageous feature of the present invention, an intermediate element can be placed between the tilting element and the hinge housing. This may advantageously serve to maintain the bearing point of the tilting element accurately and permanently. Also, wear between the tilting element and the hinge housing may be prevented by means of the intermediate element. Moreover, noise produced by tilting the tilting element may thus be reliably avoided.

The intermediate element is advantageously made of plastic, since the plastic is able to elastically deform, and thus is able to dissipate force peaks between the tilting element and the hinge housing which may lead to wear and noise. Additionally, an intermediate element is able to be produced particularly cost-effectively from plastic.

The intermediate element may bear loosely against the hinge housing and, in particular, slide on the hinge housing. The intermediate element may have an annular basic shape, so that in particular the lifting rod may extend through the intermediate element.

According to another advantageous feature of the present invention, the intermediate element can include a latching groove for inserting the web of the washer. This configuration is in particular advantageous when using a rocker disk. The latching groove permits a particularly accurate positioning of the web. If the tilting element were to have differently shaped bearing projections, the intermediate element could also comprise differently shaped recesses or indentations for receiving the bearing projections.

According to another advantageous feature of the present invention, the web may only be partially introduced into the latching groove in order not to hinder a tilting of the rocker disk. If the intermediate element is made of sufficiently flexible material, for example plastic, the web may also be fully introduced into the latching groove. The washer may then bear with its side facing the hinge housing flat against the intermediate element. When rotating and/or pivoting the lifting rod and thus also the compression spring, the intermediate element may be sufficiently firmly pressed in for the rocker element to remain pivotable, such that the compression spring remains straight and does not buckle.

According to another advantageous feature of the present invention, the tilting element, in particular the rocker disk, can be shaped in an edge region (in particular on the outer face) with an anti-twist protection insert for engagement by the intermediate element. As a result, the tilting element is particularly reliably prevented from twisting (for example according to the "poka-yoke" principle). This is particularly advantageous in order to hold the alignment of the web parallel to the tilt axis or rotational axis of the tilting element, which in turn also assists easy tilting of the compression spring over the long term. Moreover, a reliable radial centering of the tilting element may be achieved relative to the lifting rod, whereby it is ensured that the tilting element does not come into contact with the lifting rod. This in turn prevents friction between the tilting element and the lifting rod, further assisting a spring movement without friction and noise prevention. The shaping of the edge region may be implemented, for example, by means of at least one radial recess or projection in the edge region, for example by a plurality (for example three or four) angularly offset recesses. The intermediate element may comprise at least one projection which is oriented in the direction of the tilting element (for example a tab, also denoted as centering clip) and which engages in the corresponding recess or passes through the recess.

According to another advantageous feature of the present invention, the intermediate element can include a plurality of projections which are oriented in the direction of the tilting element and which surround the compression spring on the outer face. These projections may serve for anti-twist protection (for example according to the "poka-yoke" principle) and/or as protection from radial displacement of the tilting element as already set forth above. By the extension to the side of the compression spring, alternatively or additionally a radial centering of the compression spring is achieved. As a result, the projections may surround the compression spring on the outer face for the centering thereof. This further improves a spring movement without friction, in particular also over the long term. The projections may be of tab-like configuration and also denoted as centering clips.

The projections can be configured differently which may facilitate an engagement with the tilting element. For example, the intermediate element may comprise a plurality of pairs of opposing projections (for example two pairs with a total of four projections), wherein the tabs of one pair are shaped equally and the tabs of different pairs are shaped differently. For example, the tabs of one pair in each case may comprise an integral projection whilst the tabs of a different pair are divided in two and/or have a slot. Alternatively, all projections may be configured equally.

The lifting rod can be made of metal so that it may be configured in a particularly stable manner.

According to another advantageous feature of the present invention, the lifting rod can include a cavity located along its longitudinal extent. This provides the advantage that the cavity is able to be used as receiver space for further functional elements which do not then require any further constructional space. The lifting rod may, for example, have a hollow cylindrical basic shape. The cavity may be open on the front face facing the hinge housing for the particularly easy introduction of a functional element or open on the front face remote from the hinge housing or open on both front faces. Also, by means of the cavity weight may be saved without noticeably reducing the mechanical stability.

The lifting rod can include at least one longitudinal slot. Thus even more weight may be saved. The longitudinal slot constitutes a through-hole between the cavity and the surroundings of the lifting rod. In order to keep the loss of stability of the lifting rod particularly low, the at least one longitudinal slot is arranged in a pivoting plane of the lifting rod, for example on a lower face or on an upper face. Additionally, the at least one longitudinal slot may be used in order to introduce or to pass through a functional element located into the cavity. As a result, the functional element may be prevented from twisting. Moreover, the compression spring is thus able to be supported on the functional element, whereby the buckling of the compression spring may be prevented in an even more reliable manner. If a contact surface between the functional element and the spring consists of plastic, noise produced by the compression spring sliding on the functional element may be kept low, in particular practically avoided.

According to another advantageous feature of the present invention, the lifting rod can include two—in particular opposing—longitudinal slots. The weight saving may be further increased thereby. Moreover, the compression spring is now optionally able to be supported on both sides on the functional element, whereby the buckling of the compression spring may be prevented in an even more reliable manner and in addition to reducing noise a radial centering of the compression spring is achieved which prevents in a particularly reliable manner the sliding of the compression spring directly on the lifting rod, and namely in both pivoting directions. The lifting rod may, for example, comprise and/or consist of two hollow cylindrical longitudinal sections arranged mirror-symmetrically to one another and spaced apart from one another by the longitudinal slot (also able to be denoted as lifting-guide rods).

According to another advantageous feature of the present invention, a functional element accommodated in the cavity can be a shock absorber. Thus a movement of the door may be damped for improved handling during a movement procedure. An associated shock absorber housing may protrude through the at least one longitudinal slot from the lifting rod, in order to prevent a twisting of the shock absorber and to serve as a support for the compression spring. The function as a spring support may serve for spring centering, spring support and for providing a sliding surface for the spring windings. At least one contact surface of the shock absorber housing advantageously consists of plastic, in order to keep the sliding friction with the compression spring and as a result the sliding noise low. The shock absorber housing may consist entirely of plastic.

According to another advantageous feature of the present invention, the compression spring can bear with its second spring end remote from the hinge housing against a terminal element. This permits a particularly reliable support and a particularly linear retention of the compression spring on the lifting rod. The bearing portion of the lifting rod thus has a terminal element or may be configured as a terminal element.

The terminal element may be a disk ("swinging disk"). The terminal element may alternatively be a limiting part inserted into the lifting rod (also able to be denoted as a spring stop or locking wedge), for example a sheet metal part. The spring stop may be latchable and/or latched into the lifting rod. By selecting the width of the spring stop (in the longitudinal direction of the lifting rod) a spring pretensioning may be adjusted in a simple manner. In particular, a fine calibration may be undertaken in a simple manner in a final inspection and compensation of production tolerances (spring/mechanism) carried out.

According to another advantageous feature of the present invention, the terminal element (in particular if it is configured as a spring stop) on its edge facing the compression spring can include centering chamfers in order to center the compression spring radially. The centering chamfers may bear on the inner face against the compression spring and/or penetrate the compression spring. As a result, a lateral or radial positive connection is achieved between the compression spring and the spring stop.

According to another advantageous feature of the present invention, the terminal element (in particular if it is configured as a spring stop) on its edge remote from the compression spring can include further centering chamfers in order to position the spring stop accurately on the lifting rod and/or the two lifting guide rods. The further centering chamfers may also serve for preventing the lifting rod from sliding out. The further centering chamfers may be configured as notches.

According to another advantageous feature of the present invention, a vertical swing distance of a second spring end of the compression spring remote from the hinge housing can be between 40 mm and 60 mm.

According to another aspect of the present invention, a domestic appliance can include a domestic appliance door and at least such a horizontal hinge connected to the domestic appliance door configured for allowing the domestic appliance door to close a loading opening. For example, the domestic appliance may be a domestic cooking appliance which includes a cooking chamber having a loading opening, a horizontally pivotable cooking appliance door configured for closing the loading opening, and a horizontal hinge connected to the cooking appliance door, the horizontal hinge comprising a hinge housing having a front face and a rear face, a rotatable hinge arm protruding from the front face of the hinge housing for retaining the cooking appliance door, a lifting rod protruding from the rear face of the hinge housing and coupled to the hinge arm, the lifting rod being pivotable when the hinge arm is caused to rotate, a compression spring placed over the lifting rod outside the hinge housing and held under compressive stress between the hinge housing and a bearing portion of the lifting rod, and a tilting element tiltably bearing against the hinge housing between the compression spring and the hinge housing.

The domestic appliance may be configured in a similar manner to the horizontal hinge and has the same advantages.

As described above, the domestic appliance door can be a cooking appliance door, in particular an oven door. Advantageously, the domestic appliance door is connected to two horizontal hinges, which may, for example, be arranged to the left and right of the loading opening of a treatment chamber of the associated domestic appliance. The treatment chamber may be a cooking chamber or a further food preparation chamber, for example an oven chamber.

According to still another aspect of the present invention, a method for mounting a horizontal hinge includes feeding a tilting element over a lifting rod in a direction of a hinge housing, feeding a compression spring over the lifting rod, and fastening a terminal element to the lifting rod such that a hinge-housing-remote end of the compression spring bears against the terminal element to thereby tension the compression spring. The method may be configured in a similar manner to the horizontal hinge and/or to the domestic cooking appliance and has the same advantages.

According to another advantageous feature of the present invention, an intermediate element made of plastic can be placed between the tilting element and the hinge housing, wherein feeding the tilting element over the lifting rod includes engaging a front web of the tilting element in a latching groove of the intermediate element. The tilting element may be configured as a washer which in the center has the web in the form of a continuous projecting web. The washer is fed with its projecting web at the front in the direction of the intermediate element until the projecting web engages in the latching groove.

BRIEF DESCRIPTION OF THE DRAWINGS

The above described properties, features and advantages of this invention and the manner in which they are achieved become clearer and significantly more comprehensible in connection with the following schematic description of an exemplary embodiment which is described in more detail in connection with the drawings.

DETAILED DESCRIPTION OF EXEMPLARY EMBODIMENTS OF THE PRESENT INVENTION

Figure 6A:
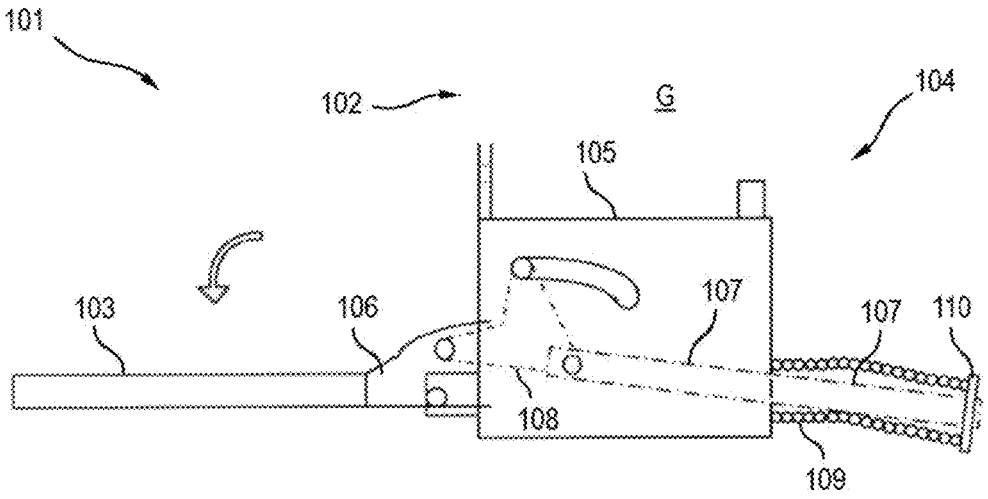
FIG. 6A shows as a sectional drawing in side view a detail of a further domestic cooking appliance in an open position.

Turning now to the drawing, and in particular to FIG. 6A, there is shown a sectional drawing in side view a detail of an exemplary domestic cooking appliance 101, for example an oven, which includes a cooking chamber G with a loading opening 102 on the front face. The loading opening 102 is able to be closed by a horizontally pivotable cooking appliance door 103, which is connected to at least one horizontal hinge 104. The horizontal hinge 104 is shown in an open position in which the door 103 opens up the loading opening 102. The horizontal hinge 104 has a rotatable hinge arm 106 protruding from the front face of a hinge housing 105 for retaining the cooking appliance door 103. The horizontal hinge 104 further includes a lifting rod 107 protruding from the rear face of the hinge housing 105 and mechanically coupled to the hinge arm 106. For coupling to the hinge arm 106, a portion of the lifting rod 107 located in a hinge housing 105 is rotatably connected to an intermediate part 108 which is also rotatably connected to the hinge arm 106. The intermediate part 108 is able to be guided by means of the hinge housing 105. A spring (compression spring 109) is placed over and/or positioned on the portion of the lifting rod 107 located outside the hinge housing 105. The compression spring 109 bears with its first end (proximal end relative to the hinge housing 105) against the hinge housing 105 and with its second end remote from the hinge housing 105 (distal end relative to the hinge housing) against a support disk ("swinging disk" 110) connected to the lifting rod 107. The support disk 110 thus used as a terminal element forms a bearing portion of the lifting rod 107. The compression spring 109 is under compressive stress. Since in the open position the lifting rod 107 is oriented obliquely downwardly, starting from the intermediate part 108, this leads to a bending of the compression spring 109 which as a result comes into contact with the lifting rod 107 on the lower face.

Figure 6B:
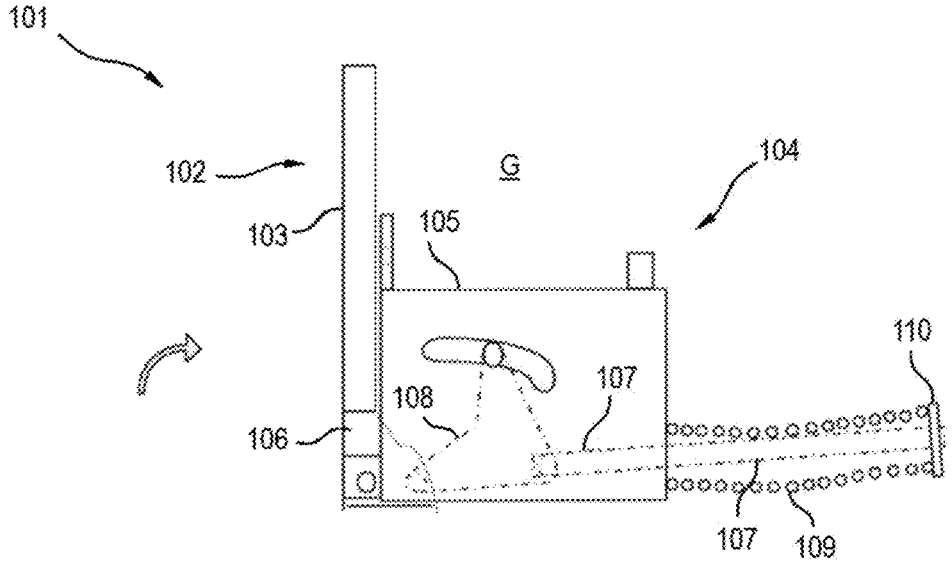
FIG. 6B shows as a sectional drawing in side view a detail of the further domestic cooking appliance in a closed position.

FIG. 6B shows the domestic cooking appliance 101 in a view similar to FIG. 6A with the horizontal hinge 104 in a closed position in which the cooking appliance door 103 closes the loading opening 102. By rotating the hinge arm 106, the intermediate part 108 in the hinge housing 105 is displaced and rotated and the lifting rod 107 is correspondingly moved. More specifically, the lifting rod 107 has been rotated counterclockwise so that starting from the intermediate part 108 it is now oriented obliquely upwardly. This leads to the bending of the compression spring 109 in the other direction, therefore, whereby the compression spring now comes into contact with the lifting rod 107 on the upper face. Additionally, the lifting rod 107 now protrudes further out of the hinge housing 105 so that the compression spring 109 is under less compressive stress. The corresponding energy loss in the compression spring 109 is used for assisting the movement of the door from the open position into the closed position. Conversely, the compression spring 109 dampens an opening movement of the cooking appliance door 103 by energy absorption.

The contact of the lifting rod 107 by the biased compression spring 109 leads to uncontrolled friction and thus to force losses when the cooking appliance door 103 is moved. It may also lead to noise being produced (creaking, squeaking) when the cooking appliance door 103 is moved.

Figure 1A:
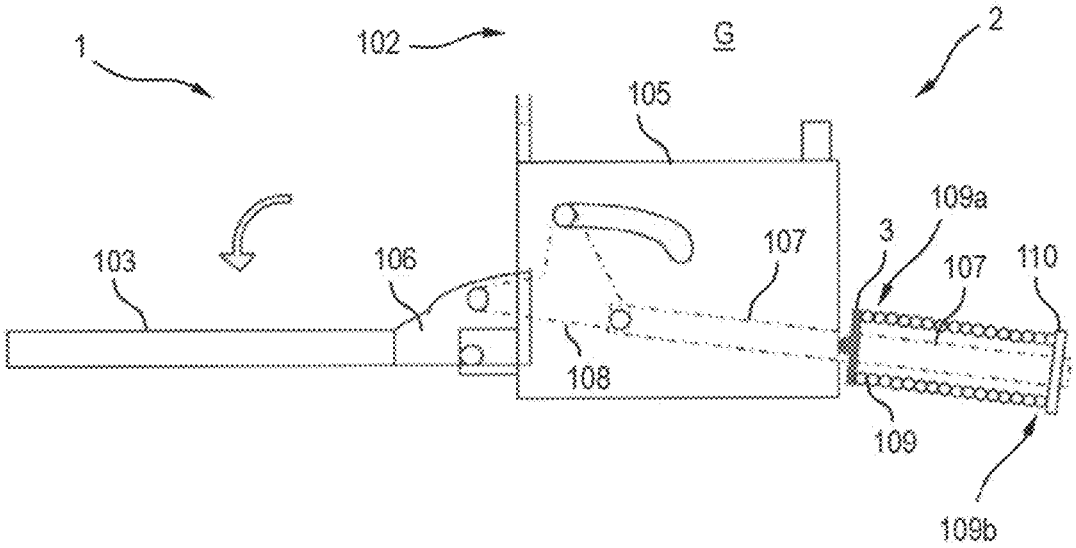
FIG. 1A shows as a sectional drawing in side view a detail of a domestic cooking appliance with a horizontal hinge according to a first exemplary embodiment in an open position.

To address the problem of force loss and noise, reference is now made to FIG. 1A which shows as a sectional drawing in side view a detail of a domestic cooking appliance 1 with a horizontal hinge 2 in an open position. The domestic cooking appliance 1 differs from the domestic appliance 101 in that on the horizontal hinge 2 a tilting element 3 bearing tiltably against the hinge housing 105 is present between the compression spring 109—configured as a spiral spring—and the hinge housing 105. The tilting element 3 is automatically adjusted to a tilt angle relative to the hinge housing 105, such that the compression spring 109 is compressed in a rectilinear manner between the tilting element 3 and the swinging disk 110. To this end, the compression spring 109 bears with a first (proximal) spring end 109*a* against the tilting element 3 and bears with its second (distal) spring end 109*b* against the swinging disk 110. At least one of the spring ends 109*a* and/or 109*b* may be surface ground.

In particular, it is possible for the tilting element 3 to have been fed over the lifting rod 107 in the direction of the hinge housing 105, then the compression spring 109 to have been fed with its first spring end 109*a* at the front over the lifting rod 107 and then the swinging disk 110 to have been fastened to the lifting rod 107 so that the compression spring 109 is tensioned.

Figure 1B:
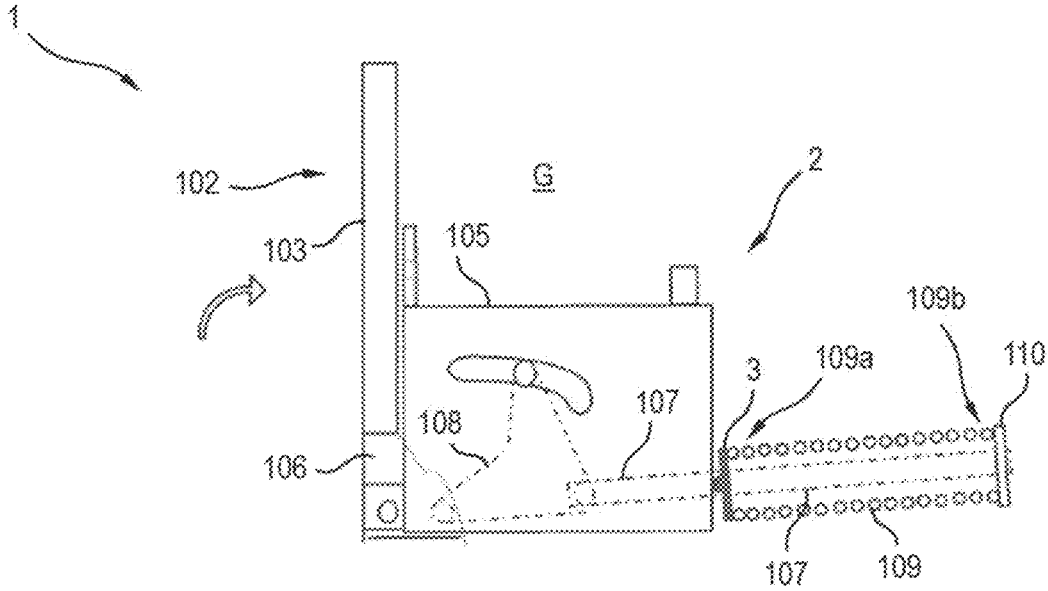
FIG. 1B shows as a sectional drawing in side view a detail of the domestic cooking appliance according to FIG. 1A with the horizontal hinge according to the first exemplary embodiment in a closed position.

FIG. 1B shows the domestic cooking appliance 1 with the horizontal hinge 2 in a closed position. The tilting element 3 has participated in the rotation of the lifting rod 107 and the compression spring 109 and correspondingly adapted its tilting relative to the hinge housing 105, so that now the compression spring 109 is rectilinear and namely aligned parallel to the lifting rod 107. A vertical swing distance of the second spring end 109*b* between the open position and the closed position is ca. 50 mm.

Figure 2A:
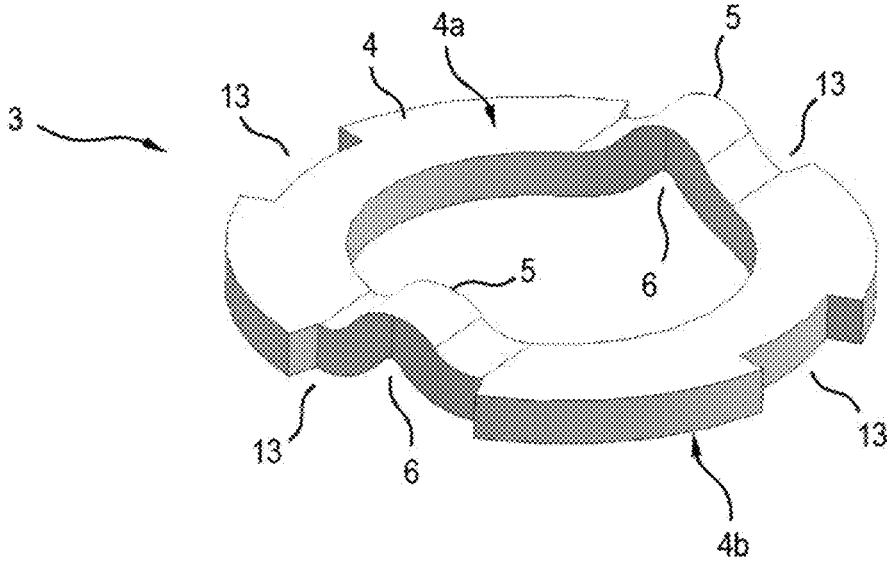
FIG. 2A shows in an oblique view a tilting element of the horizontal hinge according to the first exemplary embodiment.

FIG. 2A shows in an oblique view a possible tilting element 3 of the horizontal hinge 2. The tilting element 3 is a washer 4 which in the center has a continuous projecting web 5. The web 5, for example, may have been introduced by deep-drawing. The web 5 protrudes toward a front face 4*a* facing the hinge housing 105. The web 5 has been produced by deep-drawing so that a notch 6 is present on the rear face 4*b*, not shown, of the washer, which does not limit the functionality of the tilting element 3. The tilting element 3 may optionally comprise lateral recesses 13 in the outer edge region of the washer 4 (see also FIG. 4A).

Figure 2B:
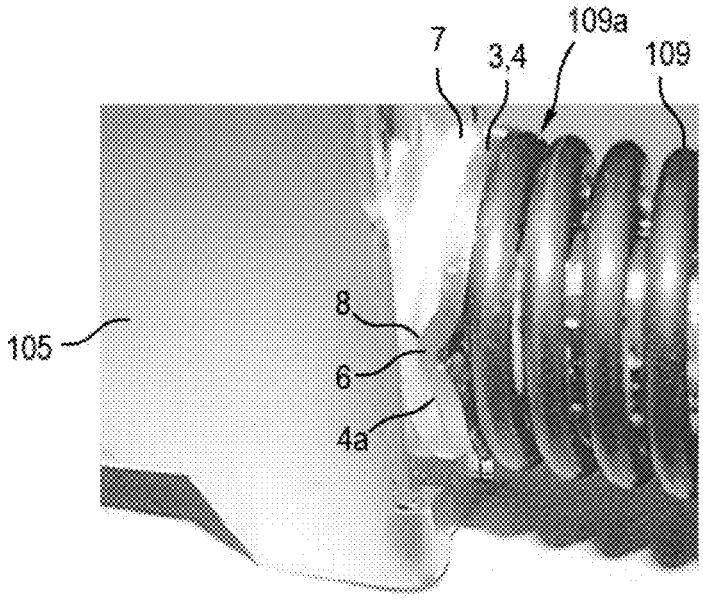
FIG. 2B shows in an oblique view a detail of the horizontal hinge according to the first exemplary embodiment in the region of the tilting element.

FIG. 2B shows in an oblique view a detail of the horizontal hinge 2 in the region of the tilting element 3. An intermediate element 7 which is made of plastic and which has an elongate indentation or "latching groove" 8 for the at least partial introduction of the web 5 of the washer 4 may be present between the washer 4 and the hinge housing 105. The web 5 penetrates or engages in the latching groove 8. The intermediate element 7 is sufficiently flexible that the front face 4*a* of the washer 4 is able to bear flat thereagainst without noticeably impairing the tiltability of the washer 4. However, a previously introduced latching groove 8 may also be dispensed with, the web 5 then pressing for example into the intermediate element 7 such that here a corresponding indentation is produced.

Figure 3:
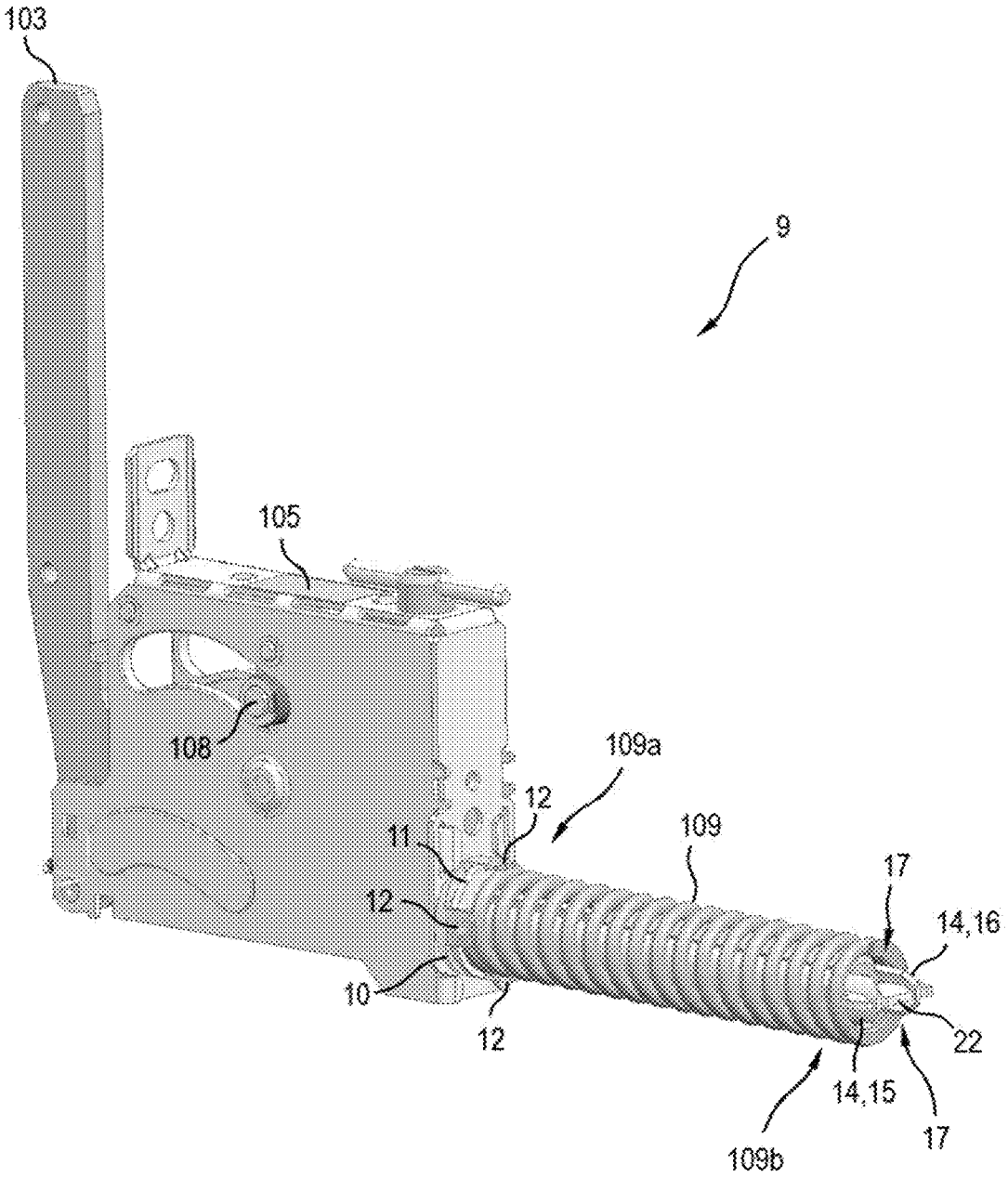
FIG. 3 shows in an oblique view a horizontal hinge according to a second exemplary embodiment in a closed position.

FIG. 3 shows in an oblique view a horizontal hinge 9 in a closed position. The horizontal hinge 9 may also be used in the domestic cooking appliance 1. The horizontal hinge 9 is constructed in a similar manner to the horizontal hinge 2, wherein however now the intermediate element 10 on the outer face additionally has four tab-like projections 12 protruding to the side in the direction of a tilting element 11 and/or the compression spring 109. The projections 12 are angularly offset by 90° in the peripheral direction. The projections 12 are shown here configured as simple tabs; but for example two opposing projections 12 may also be configured in two parts, for example with a central slot (not shown).

Figure 4A:
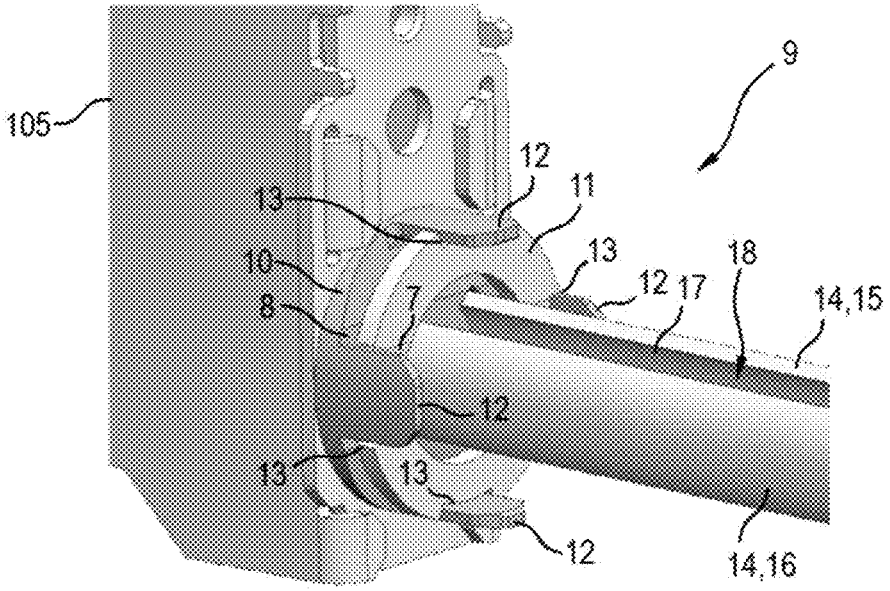
FIG. 4A shows in an oblique view a detail of the horizontal hinge according to the second exemplary embodiment in the region of a hinge housing without a compression spring.

As shown more clearly in FIG. 4A, the projections 12 extend in suitable lateral recesses 13 in the outer edge region of the tilting element 11, also configured here as washer 4. As a result, an anti-twist protection insert for the tilting element 11 is produced, whereby in particular the web 5 is not able to twist. Also, the tilting element 11 is no longer able to be laterally or radially uncentered, so that the projections 12 also serve as centering elements for the tilting element 11.

However, the projections 12 extend further, namely beyond the tilting element 11 to the side over the compression spring 109 as shown in FIG. 3. As a result, they act as optionally resilient, lateral limits for the compression spring 109 and consequently also as centering elements for the radial centering of the compression spring 109. As a result, the compression spring 109 is prevented from being able to slide at its first proximal end region 109*a* on a lifting rod 14.

Figure 4B:
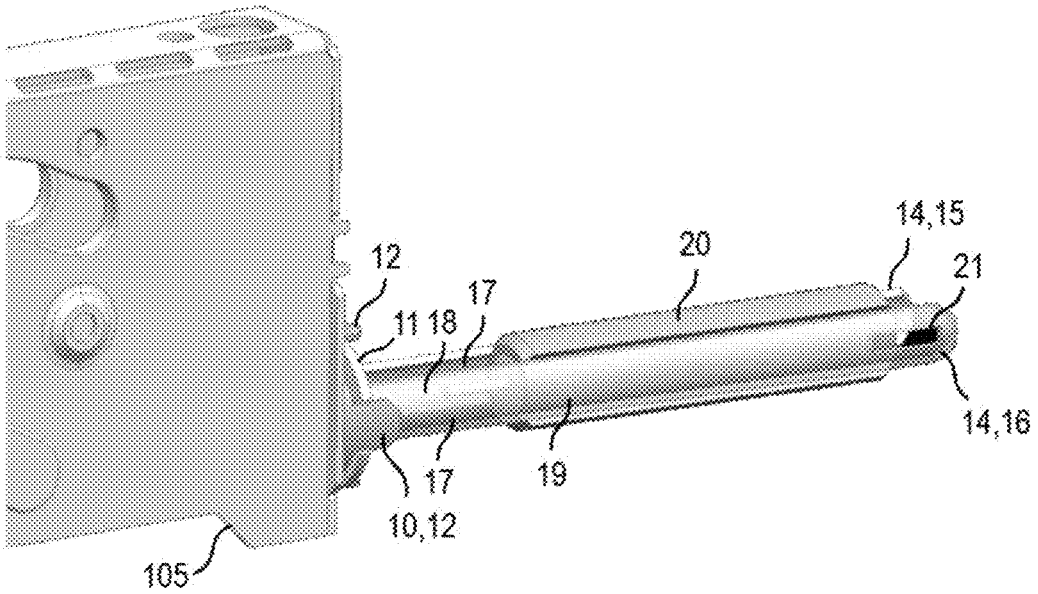
FIG. 4B shows in a further oblique view a detail of the horizontal hinge according to the second exemplary embodiment in the region of a lifting rod without the compression spring.

As also shown more clearly in FIG. 4B, the lifting rod 14 is configured in two parts with two lifting guide rods 15 and 16 which are aligned in parallel and mirror-symmetrically with one another. The lifting guide rods 15 and 16 have a circular sector-shaped cross-section and are spaced apart from one another by means of continuous longitudinal slots 17 on the upper face and lower face. The lifting guide rods 15 and 16 additionally define a cylindrical central cavity 18, a shock absorber 19 being accommodated therein. The shock absorber 19 has a shock absorber housing 20 made of plastic which protrudes from the inside through the longitudinal slot 17 to the outside, laterally from the lifting rod 14 and/or the lifting guide rods 15 and 16. The shock absorber housing 20 may protect the compression spring 109 further against buckling and additionally prevent the compression spring 109 from sliding directly with its central portion on the lifting rod 14 which is, for example, made of metal. The shock absorber housing 20 may thus serve as an internal support and a low-friction sliding surface for the compression spring 109.

In the region of the second distal end 109*b* of the compression spring 109 and/or the lifting rod 14 in each case short slotted through-holes 21 are located in the lifting guide rods 15 and 16 in the left and right side thereof. Once again with reference to FIG. 3 these through-holes 21 serve for inserting and holding a terminal element in the form of a locking wedge or spring stop 22.

Now with reference again to FIG. 4A, the lifting guide rods 15 and 16 also extend through the intermediate element 10.

Figure 5A:
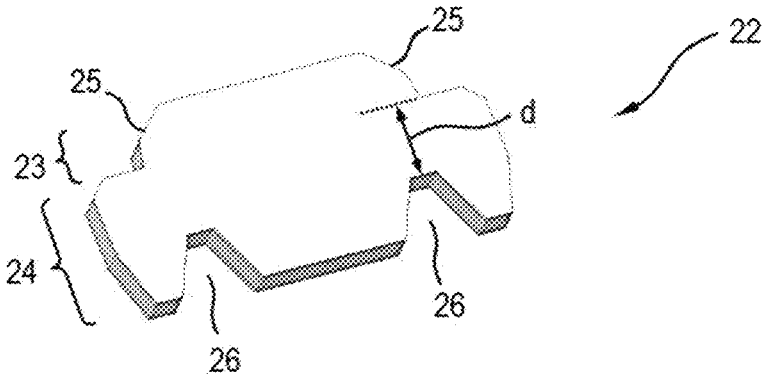
FIG. 5A shows in an oblique view a terminal element of the horizontal hinge according to the second exemplary embodiment.
Figure 5B:
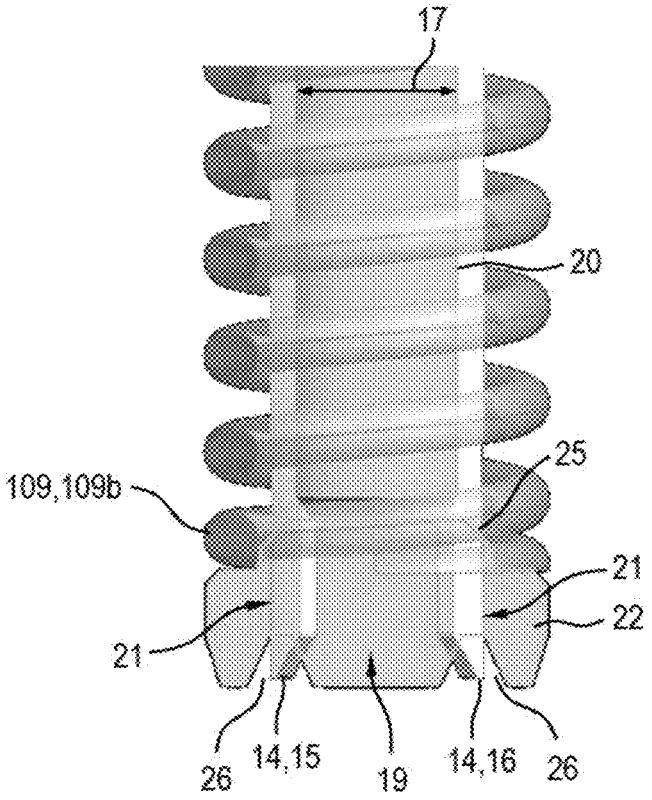
FIG. 5B shows in a plan view a detail of the horizontal hinge according to the second exemplary embodiment in the region of the terminal element.

FIG. 5A shows the spring stop 22 in an oblique view. FIG. 5B shows in a plan view a detail of the distal end region of the lifting rod 14 with the inserted spring stop 22 and compression spring 109.

The spring stop 22 is, for example, a stamped-out sheet metal part which is inserted into the through-holes 21 when the compression spring 109 is compressed, after which the compression spring 109 is relaxed. The relaxed compression spring 109 presses with its distal end 109*b* on the spring stop 22. The spring stop 22 thus serves as a rearward stop for the compression spring 109 and for the securing thereof is in turn pressed by means of the compression spring 109 onto the lifting guide rods 15 and 16.

The spring stop 22 has a front tip or nose 23 which penetrates the compression spring 109 on the inner face and which merges into a wider main region 24 in a rearward direction. An internal diameter of the compression spring 109 is wider than the nose 23 but narrower than the main region 24 so that the distal end 109*b* of the compression spring 109 bears against the main region 24.

The lateral edges of the nose 23 are configured as first centering chamfers 25 extending obliquely to the front, in order to permit a particularly accurate centering of the distal end 109*b* of the compression spring 109 and easy penetration into the compression spring 109 during mounting.

The spring stop 22 has on its rear edge two notches or second centering chamfers 26 in order to come into engagement with the lifting guide rods 15 and 16 and, as a result, to latch the spring stop 22 with the lifting guide rods 15 and 16. Thus the spring stop 22 is prevented from sliding laterally out of the through-holes 21 and the distal end 109*b* of the compression spring 109 may be centered against the lifting rod 14.

A spacing d in the longitudinal direction of the compression spring 109 and/or the lifting rod 14 between a base of the centering chamfers 26 and a transition between the nose 23 and the main region 24 (also able to be denoted as the thickness of the spring stop 22) may be varied in order to adjust in a simple manner a pretensioning of the compression spring 109, for example for fine calibration during final assembly.

Naturally the present invention is not limited to the exemplary embodiment shown.

Generally, an individual item or a plurality of items may be understood by "a" "an", etc., in particular in the sense of "at least one" or "one or more", etc. as long as this is not explicitly excluded, for example by the expression "just one", etc.

In addition, numerical information may encompass just the specified number and the usual tolerance range, as long as this is not explicitly excluded.

The invention claimed is:

1. A horizontal hinge for a cooking appliance door, said horizontal hinge comprising:

a hinge housing having a front face and a rear face;

a rotatable hinge arm protruding from the front face of the hinge housing for retaining the cooking appliance door;

a lifting rod protruding from the rear face of the hinge housing and coupled to the hinge arm, said lifting rod being pivotable when the hinge arm is caused to rotate;

a compression spring placed over the lifting rod outside the hinge housing and held under compressive stress between the hinge housing and a bearing portion of the lifting rod;

a tilting element tiltably bearing against the hinge housing between the compression spring and the hinge housing, the tilting element having an edge region shaped to form an anti-twist protection insert; and an intermediate element made of plastic and placed between the tilting element and the hinge housing, wherein the edge region of the tilting element is configured for engagement by the intermediate element.

2. The horizontal hinge of claim 1, wherein the tilting element is a washer comprising a continuous central projecting web in facing relationship to the hinge housing.

3. The horizontal hinge of claim 1, wherein the tilting element is a washer comprising a continuous central projecting web in facing relationship to the hinge housing, said intermediate element comprising a latching groove for at least partial insertion of the web of the washer.

4. The horizontal hinge of claim 1, wherein the intermediate element comprises a plurality of projections which are oriented in a direction of the tilting element and which surround the compression spring on an outer face for centering the compression spring.

5. The horizontal hinge of claim 1, wherein the compression spring has a spring end bearing against the tilting element.

6. The horizontal hinge of claim 1, further comprising a terminal element connected to the lifting rod, said compression spring having a spring end which is remote from the hinge housing and bears against the terminal element.

7. The horizontal hinge of claim 6, wherein the terminal element is configured in at least one of two ways, a first way in which the terminal element has an edge in facing relationship to the compression spring, said edge comprising centering chamfers sized to penetrate the compression spring, a second way in which the terminal element has an edge positioned remote from the compression spring and comprising centering chamfers for positioning on the lifting rod.

8. The horizontal hinge of claim 1, wherein the compression spring has a spring end which is remote from the hinge housing and defined by a vertical swing distance between 40 mm and 60 mm.

9. The horizontal hinge of claim 1, wherein the lifting rod comprises two opposing longitudinal slots and a cavity which is located along a longitudinal extent of the lifting rod, and further comprising a shock absorber including a shock absorber housing made of plastic, said shock absorber being inserted into the cavity, with the shock absorber housing being configured to extend through the longitudinal slots so as to protrude from the lifting rod.

10. A domestic cooking appliance, comprising:

a cooking chamber having a loading opening;

a horizontally pivotable cooking appliance door configured for closing the loading opening; and a horizontal hinge connected to the cooking appliance door, said horizontal hinge comprising a hinge housing having a front face and a rear face, a rotatable hinge arm protruding from the front face of the hinge housing for retaining the cooking appliance door, a lifting rod protruding from the rear face of the hinge housing and coupled to the hinge arm, said lifting rod being pivotable when the hinge arm is caused to rotate, a compression spring placed over the lifting rod outside the hinge housing and held under compressive stress between the hinge housing and a bearing portion of the lifting rod, a tilting element tiltably bearing against the hinge housing between the compression spring and the hinge housing, the tilting element having an edge region shaped to form an anti-twist protection insert, and an intermediate element made of plastic and placed between the tilting element and the hinge housing, wherein the edge region of the tilting element is configured for engagement by the intermediate element.

11. The domestic cooking appliance of claim 10, wherein the tilting element is a washer comprising a continuous central projecting web in facing relationship to the hinge housing.

12. The domestic cooking appliance of claim 10, wherein the tilting element is a washer comprising a continuous central projecting web in facing relationship to the hinge housing, said intermediate element comprising a latching groove for at least partial insertion of the web of the washer.

13. The domestic cooking appliance of claim 10, wherein the intermediate element comprises a plurality of projections which are oriented in a direction of the tilting element and which surround the compression spring on an outer face for centering the compression spring.

14. The domestic cooking appliance of claim 10, wherein the compression spring has a spring end bearing against the tilting element.

15. The domestic cooking appliance of claim 10, wherein the horizontal hinge includes a terminal element connected to the lifting rod, said compression spring having a spring end which is remote from the hinge housing and bears against the terminal element.

16. The domestic cooking appliance of claim 15, wherein the terminal element is configured in at least one of two ways, a first way in which the terminal element has an edge in facing relationship to the compression spring, said edge comprising centering chamfers sized to penetrate the compression spring, a second way in which the terminal element has an edge positioned remote from the compression spring and comprising centering chamfers for positioning on the lifting rod.

17. The domestic cooking appliance of claim 10, wherein the compression spring has a spring end which is remote from the hinge housing and defined by a vertical swing distance between 40 mm and 60 mm.

18. The domestic cooking appliance of claim 10, wherein the lifting rod comprises two opposing longitudinal slots and a cavity which is located along a longitudinal extent of the lifting rod, said horizontal hinge comprising a shock absorber including a shock absorber housing made of plastic, said shock absorber being inserted into the cavity, with the shock absorber housing being configured to extend through the longitudinal slots so as to protrude from the lifting rod.

19. A method for mounting a horizontal hinge, said method comprising:

feeding a tilting element over a lifting rod in a direction of a hinge housing, wherein the tilting element has an edge region shaped to form an anti-twist protection insert, feeding a compression spring over the lifting rod; and fastening a terminal element to the lifting rod such that a hinge-housing-remote end of the compression spring bears against the terminal element to thereby tension the compression spring, and providing an intermediate element made of plastic and placed between the tilting element and the hinge housing, wherein the edge region of the tilting element is configured for engagement by the intermediate element.

20. The method of claim 19, further comprising placing an intermediate element made of plastic between the tilting element and the hinge housing, wherein feeding the tilting element over the lifting rod includes engaging a front web of the tilting element in a latching groove of the intermediate element.

* * * * *